US005737669A

United States Patent [19]

Ring

[11] Patent Number: 5,737,669

[45] Date of Patent: Apr. 7, 1998

[54] MONOCHROME/MULTICHROME BAND PRINTER

[75] Inventor: John Joseph Ring, Cherry Hill, N.J.

[73] Assignee: Oki America, Inc., Hackensack, N.J.

[21] Appl. No.: 478,066

[22] Filed: Jun. 7, 1995

[51] Int. Cl.[6] ..... G03G 15/22

[52] U.S. Cl. ..... 399/130; 359/162; 347/112

[58] Field of Search ..... 347/116, 119, 347/153, 112, 154; 399/130, 162, 164, 163; 400/118.2, 118.3

[56] References Cited

U.S. PATENT DOCUMENTS

| | | | |
|---|---|---|---|
| 3,934,257 | 1/1976 | Pasini | 354/5 |
| 4,217,819 | 8/1980 | Tluck et al. | 347/153 |
| 4,317,137 | 2/1982 | Tompkins | 358/286 |
| 4,745,560 | 5/1988 | Decker et al. | 364/519 |
| 4,845,519 | 7/1989 | Fuse | 347/112 |
| 4,856,920 | 8/1989 | Sanders, Jr. | 400/124 |
| 4,897,677 | 1/1990 | Lai | 346/188 |
| 4,928,119 | 5/1990 | Walker et al. | 346/108 |
| 4,956,662 | 9/1990 | Sakai et al. | 355/27 |
| 5,025,269 | 6/1991 | Saeki et al. | 346/108 |
| 5,083,144 | 1/1992 | Altmann | 346/157 |
| 5,166,999 | 11/1992 | Rees et al. | 385/120 |
| 5,229,787 | 7/1993 | Rees et al. | 346/107 R |
| 5,274,397 | 12/1993 | Grover | 346/108 |
| 5,351,115 | 9/1994 | Yamamoto et al. | 355/326 R |

FOREIGN PATENT DOCUMENTS

| | | | |
|---|---|---|---|
| 25 35 987 | 2/1977 | Germany . | |
| 63-52155 | 3/1988 | Japan | 355/326 |

*Primary Examiner*—Joan H. Pendegrass

*Attorney, Agent, or Firm*—Panitch Schwarze Jacobs & Nadel, P.C.

[57] ABSTRACT

A band printer having a transport mechanism, an endless photoreceptive image carrying ribbon, a latent toner imaging apparatus, a transfer mechanism, and a fixing mechanism is disclosed. The transport mechanism defines a printing medium path extending in a first direction and transports a printing medium along the printing medium path. The endless photoreceptive image carrying ribbon circulates adjacent the printing medium path in a second direction at an angle to the first direction, and the latent toner imaging apparatus is adjacent to and stationary with respect to the circulating ribbon. The imaging apparatus forms an electrostatic latent toner image on the surface of the ribbon according to received image data as the ribbon moves past the imaging apparatus, and the transfer mechanism transfers the formed toner image to the printing medium when the formed toner image is aligned with the printing medium. Thereafter, the fixing mechanism fixes the image to the printing medium.

66 Claims, 4 Drawing Sheets

FIG. 3
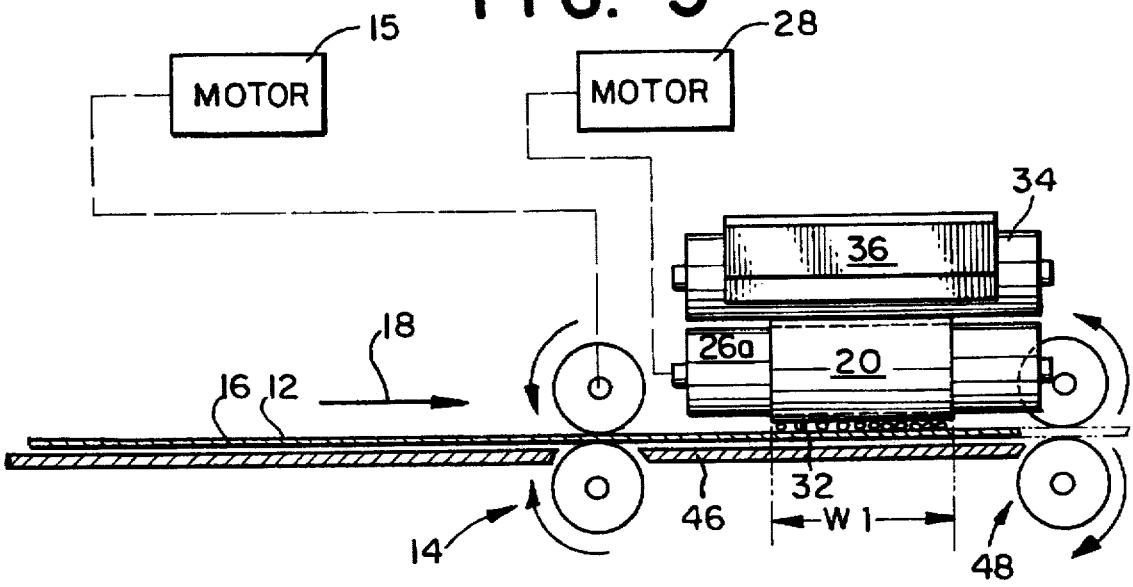
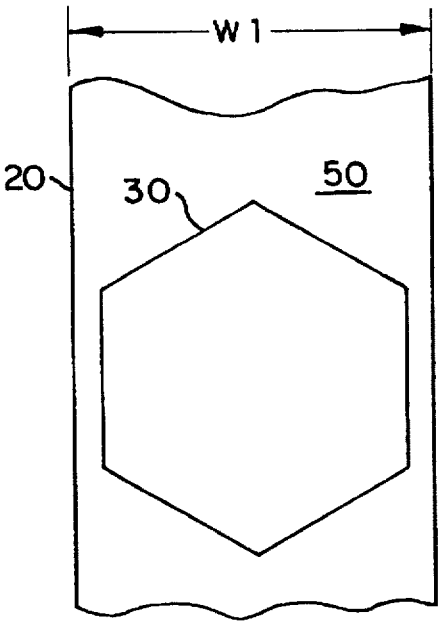
FIG. 4a
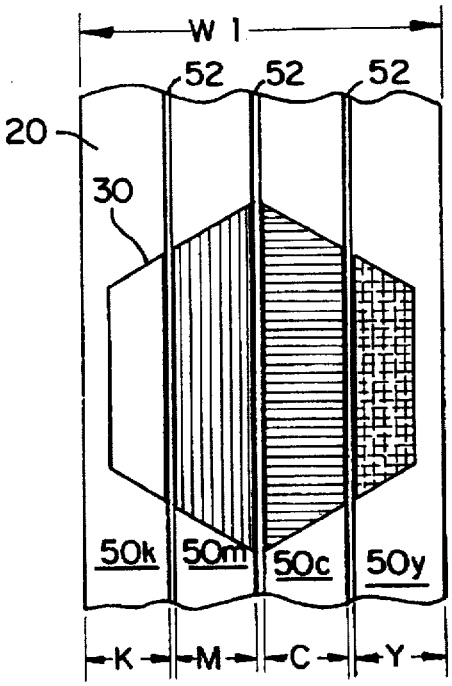
FIG. 4b

MONOCHROME/MULTICHROME BAND PRINTER

FIELD OF THE INVENTION

The present invention relates generally to a printer and a method for printing. More particularly, the present invention relates to a band printer having an endless photo-receptive image-carrying ribbon which is circulated in a direction at an angle to the direction of transportation of a printing medium.

BACKGROUND OF THE INVENTION

As is known, a laser or LED-array printer typically has a photo-receptive image-carrying drum that is employed to print a monochrome image on a printing medium such as a sheet of paper. In operation, the drum is continuously rotated past an imaging apparatus having several devices to form an electrostatic latent image on the surface of the drum and to print the monochrome image on a printing medium based on the electrostatic image. The devices of the imaging apparatus include a charging device that places a generally uniform charge on the drum surface, a light device such as a laser or an LED-array head that selectively discharges portions of the drum surface to form the electrostatic image, a developing device that applies a toner to the electrostatic image to form a monochrome toner image on the drum surface, a transfer device that transfers the monochrome toner image from the drum surface to a printing medium moving in synchronization with the drum surface, and a cleaning device that removes any residual toner left over after the image has been transferred from the drum surface. After the monochrome toner image has been transferred, a fixing station fixes the image to the printing medium, usually through the application of pressure and/or heat, and the printed printing medium is ejected from the drum printer.

However, the drum printer as described above has several disadvantages. For example, the drum of the printer and the aforementioned elements positioned adjacent the drum surface are relatively large elements since they all must be at least as wide as a sheet of a printing medium, on the order of 8.5 to 12 inches or larger. As should be evident, then, such relatively large drum and related printer components combine to form a drum printer having a relatively large footprint as compared with other computer hardware units.

Additionally, if an LED-array head is employed in connection with the drum printer, the head must be at least as wide as the drum, again on the order of 8.5 to 12 inches, so that an electrostatic image is formed on the drum surface during a single pass of the drum. If a laser is employed, relatively sophisticated mirrors and/or prisms must be employed for the same purpose. As should be recognized, the relatively long LED-array head or the lasers and related optical devices represent a significant portion of the cost of producing the drum printer.

Further, the drum printer as described above cannot easily be employed to produce multichrome or color images on the printing medium. Two methods are generally employed to produce multichrome images. In the first method, the drum is rotated a number of times (typically four) to selectively overlay different colors of toner (typically black, magenta, cyan, and yellow) from different toner bins during each of the rotations. After all the different colors of toner are applied, the multichrome image is transferred to the printing medium.

In the second method, multiple drum stations each having a drum and associated imaging apparatus are arranged in a row such that a single color of toner is applied and fixed at each drum station. As should be evident, the aforementioned methods present many problems, especially with regard to the complexities incumbent in applying multiple colors of toner, aligning print images, and synchronizing print operations, for example. Moreover, a printer having multiple toner bins and/or drum stations has an especially large footprint as compared with other, more conventional drum printers.

A need exists, then, for a printer and method for printing whereby electrostaticly formed images are applied to a printing medium by a unit that is relatively small as compared with a drum printer. Additionally, a need exists for such a printer and method whereby only a relatively short LED array or image producing means is employed to form an electrostatic image on a photosensitive surface. Further, a need exists for such a printer and method whereby the printer can form multichrome or color images on the sheet of paper at a relatively low cost.

SUMMARY OF THE INVENTION

The aforementioned need is satisfied by the present invention which comprises a band printer having a transport mechanism, an endless photoreceptive image carrying ribbon, a latent toner imaging apparatus, a transfer mechanism, and a fixing mechanism. The transport mechanism defines a printing medium path extending in a first direction and transports a printing medium along the printing medium path. The endless photoreceptive image carrying ribbon is circulated adjacent the printing medium path in a second direction at an angle to the first direction, and the latent toner imaging apparatus is adjacent to and stationary with respect to the circulating ribbon. The imaging apparatus forms an electrostatic latent toner image on the surface of the ribbon according to received image data as the ribbon moves past the imaging apparatus, and the transfer mechanism transfers the formed toner image to the printing medium when the formed toner image is aligned with the printing medium. After the toner image is transferred, the fixing mechanism fixes the image to the printing medium.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings:

FIG. 3 is a cross-sectional view taken along line 3—3 in FIG. 2;

FIGS. 4*a* and 4*b* show images formed on the ribbon of FIGS. 1–3 during monochrome printing (FIG. 4*a*) and during multichrome printing (FIG. 4*b*);

DETAILED DESCRIPTION OF PREFERRED EMBODIMENTS

Figure 1:
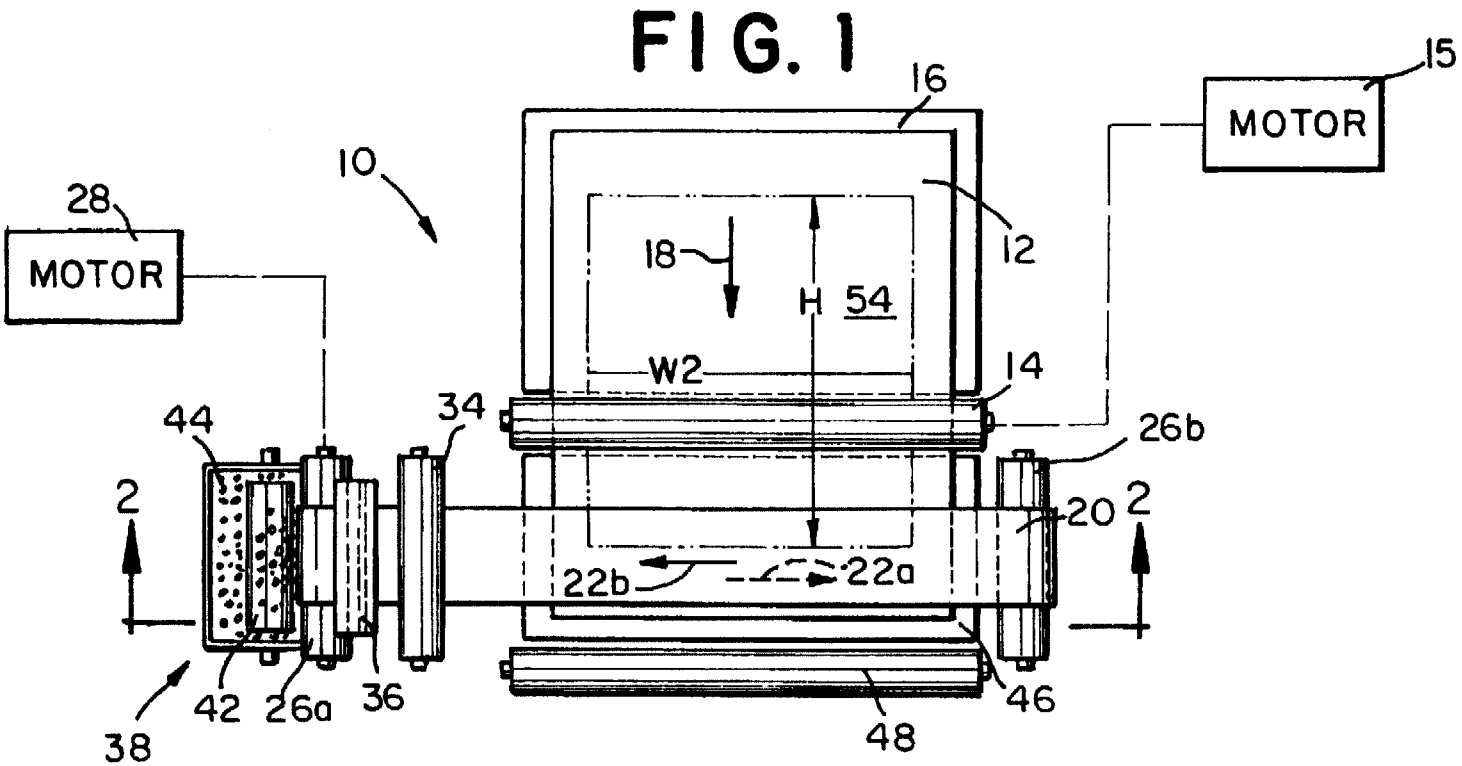
FIG. 1 is a diagrammatic plan view of a monochrome/multichrome band printer in accordance with a preferred embodiment of the present invention.

Certain terminology may be used in the following description for convenience only and is not limiting. For example, the words "left", "right", "upper", and "lower" designate directions in the drawings to which reference is made, and the words "inwardly" and "outwardly" are further directions toward and away from, respectively, the geometric center of a referenced object. The terminology includes the words above specifically mentioned, derivatives thereof, and words of similar import.

Referring to the drawings in detail, wherein like numerals are used to indicate like elements throughout, there is shown in FIG. 1 a preferred embodiment of a monochrome or a multichrome band printer 10 for printing an image on a printing medium 12. As seen, the printer 10 has a transport mechanism 14 (also seen in FIG. 3) that defines a printing medium path 16 extending in a first direction shown by the arrow 18. Accordingly, the transport mechanism 14 transports the printing medium 12 along the printing medium path 16 during the course of operation of the printer 10.

As should be understood, the printing medium 12 may be a sheet of paper, a sheet of an overhead transparency, or the like. As should also be understood, the printing medium 12 has a predetermined print area 54 including a width W2 generally orthogonal to the first direction 18 and a height H generally parallel to the first direction 18. As shown in FIG. 1, the height H and the width W2 need not necessarily be the entire height and width of the printing medium 12, and in fact, are usually at least slightly smaller than the aforementioned dimensions of the printing medium 12. As should be understood, the size of the print area 54 varies with the size of the printing medium 12.

As shown, the transport mechanism 14 may be a pair of nip rollers that contact the printing medium 14 and that urge the paper in the first direction 18. A motor 15 may be employed to operate the transport mechanism 14. Of course, one skilled in the art will recognize that any of several other known transport mechanisms may be employed without departing from the spirit and scope of the present invention. For example, such other transport mechanisms may include a moving belt, a rotating capstan, or a mechanism whereby the printing mechanism moves with respect to the printing medium 14 during printing and the printing medium 14 is stationary with respect to the printer 10 during such printing.

As best seen in FIG. 1, an endless photo-receptive image-carrying belt or ribbon 20 is circulated adjacent the printing medium path 16 in a second direction as indicated by the arrow 22*a*. Preferably, and as seen in FIG. 1, the second direction 22*a* is generally orthogonal or at a right angle with respect to the first direction 18. However, one skilled in the art will recognize that the second direction 22*a* may be at any angle with respect to the first direction 18 so long as the ribbon 20 is circulated generally across the entire width of the printing medium 12.

Figure 2:
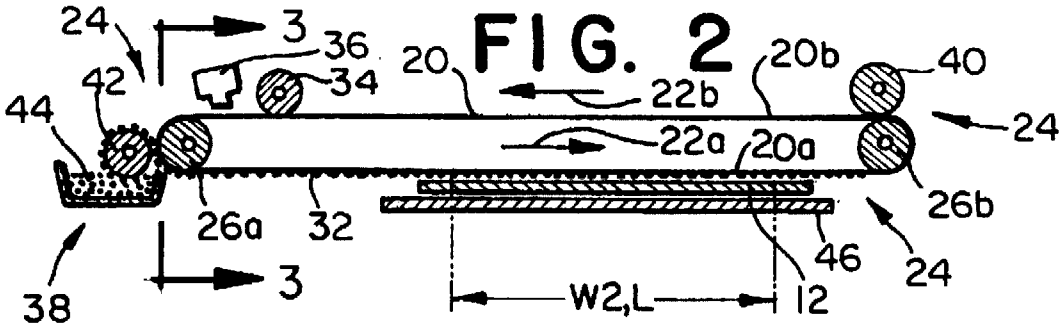
FIG. 2 is a cross-sectional view taken along line 2—2 in FIG. 1.

Preferably, and as best seen in FIGS. 1 and 2, the ribbon 20 is circulated around first and second guides 26*a*, 26*b*. As shown, the first and second guides 26*a*, 26*b* have generally parallel axes spaced a set distance apart such that the ribbon 20 is appropriately tensioned. As one skilled in the art will recognize, one or both of the guides 26*a*, 26*b* may be spring-mounted or otherwise biased in the printer 10 to provide the appropriate tensioning to the ribbon 20. As best seen in FIG. 1, the axes of the guides 26*a*, 26*b* extend generally in the first direction 18 on either side of the printing medium path 16 such that the printing medium path 16 extends therebetween.

Preferably, the first and second guides 26*a*, 26*b* are first and second rollers. Also preferably, a circulating mechanism such as a motor 28 is employed to circulate the ribbon 20 around the first and second guides 26, 28 at a predetermined velocity. As should be understood, the motor 28 preferably drives at least one of the first and second guides 26*a*, 26*b* either directly or by way of an appropriate linkage such as gears, a chain add/or belt. However, it will be understood that the motor 28 may instead drive the guides 26*a*, 26*b* indirectly such as by using one or more rollers or pulleys (not shown) separate from the first and second guides 26*a*, 26*b*. Further, it will be recognized that the motors 15 and 28 may be a single motor operating both the transport mechanism 14 and the ribbon 20 by way of appropriate linkage (not shown).

As best seen in FIG. 2, the ribbon 20 and the guides 26*a*, 26*b* collectively define an image run 20*a* and a return run 20*b*. As shown, the image run 20*a* extends from the guide 26*a* to the guide 26*b* adjacent the printing medium path 16 and the return run 20*b* extends from the guide 26*b* to the guide 26*a* distant from the printing medium path 16. Accordingly, when the ribbon 20 is circulated around the guides 26*a*, 26*b*, the image run 20*a* moves in the second direction 22*a* and the return run 20*b* moves in a third direction shown by the arrow 22*b* and generally opposite the second direction 22*a*. Preferably, the image run 20*a* is in a plane generally parallel to the plane of the printing medium path 16 such that the image run 20*a* may be moved only a short distance to substantially completely contact the printing medium 12 being transported through the printing medium path 16.

As shown in FIGS. 1–3, the ribbon 20 is an endless strip having inner and outer opposing surfaces along with a width W1. As best seen in FIG. 2, several units 34, 36, 38, 40 collectively constitute a latent toner imaging apparatus 24 and are positioned adjacent the circulating ribbon 20 and stationary with respect to the circulating ribbon 20. The latent toner imaging apparatus 24 forms an electrostatic latent toner image 30 (as seen in FIGS. 4*a* and 4*b*) on the surface of the ribbon 20 as the ribbon 20 moves past the units that constitute the imaging apparatus 24. As should be understood, the toner image 30 is formed according to image date received from a printer processor (not shown), a remote processor (not shown), or the like.

As shown in FIG. 2, the toner image 30 is preferably formed on the outer surface of the ribbon 20 from charged toner particles or toner 32. However, one skilled in the art will recognize that the units that constitute the imaging apparatus 24 as well as other elements may be arranged to form the toner image 30 on the inner surface of the ribbon 20 without departing from the spirit and scope of the present invention.

Preferably, the units that constitute the latent toner imaging apparatus 24 include a charging unit 34, an imaging unit 36, a developing unit 38, and a cleaning unit 40. As shown in FIG. 2, the charging unit 34 is located proximate to the guide 26*a*. Preferably, the charging unit 34 places a uniform charge on the ribbon 20 as the ribbon 20 passes by such that the uniformly charged ribbon 20 is ready to receive a new image. Also preferably, the charging unit 34 is a charging roller that presses and rolls against the ribbon 20. As one skilled in the art will recognize, however, the charging unit 34 may comprise other charging devices, including for example, a charging brush, wire or other similar charging devices. As one skilled in the art will also recognize, the charging unit 34 may be positioned at a location other than proximate to the guide 26a.

As also seen in FIG. 2, the imaging unit 36 is positioned adjacent the guide 26a such that the imaging unit 36 operates on the ribbon 20 after the ribbon 20 has been uniformly charged by the charging unit 34. As should be understood, the imaging unit 36 selectively discharges portions of the ribbon 20 to form a discharge image (not shown) on the ribbon 20. Preferably, the imaging unit 36 is an LED-array head. However, it will be recognized that the imaging unit 36 may instead be another imaging device such as a laser and related optical devices, or for example, an electrostatic finger device, without departing from the spirit and scope of the present invention. Additionally, it will be recognized that the imaging unit 36 may be positioned at a location other than adjacent the guide 26a as long as the imaging unit 36 operates on the ribbon 20 after the ribbon 20 has been uniformly charged by the charging unit 34. Preferably, and as seen in FIGS. 1 and 3, the imaging unit 36 extends across the width W1 of the ribbon 20. Accordingly, the entire width W1 of the ribbon 20 is exposed to the imaging unit 36 and the discharge image is formed on the ribbon 20 during a single pass of the ribbon 20.

As additionally seen in FIG. 2, the developing unit 38 is positioned adjacent the guide 26a such that the developing unit 38 operates on the ribbon 20 after the discharge image has been formed on the ribbon 20 by the imaging unit 36. As may be understood, the developing unit 38 covers the discharge image on the ribbon 20 with a thin layer of toner 32 to form the toner image 30 on the ribbon 20 (seen in FIGS. 4a and 4b). Preferably, the developing unit 38 includes at least one developer bin 44 holding the toner 32 and at least one developer roller 42 positioned adjacent the bin 44 and the ribbon 20. As should be understood, then, the developer roller 42 removes toner 32 from the developer bin 44, charges the toner 32, and contacts the charged toner 32 to the ribbon 20. As is known, the charged toner 32 is attracted only to the discharge image on the ribbon 20 and accordingly forms the toner image 30. It will be recognized that the developing unit 38 may be positioned at a location other than adjacent the guide 26a as long as the developing unit 38 operates on the ribbon 20 after the discharge image has been formed on the ribbon 20 by the imaging unit 36.

As one skilled in the art will recognize, the developing unit 38 may also comprise any of several other well known developer applying mechanisms without departing from the spirit and scope of the present invention. For example, a developer brush (not shown), a developer blower, or the like may be employed.

After the toner image 30 has been formed on the ribbon 20 by the developing unit 38, the ribbon 20 is moved to be properly positioned with respect to the printing medium 12. More particularly, and referring to FIG. 1, it should be understood that the formed toner image 30 on the ribbon 20 has a length L (as seen in FIG. 2) substantially equal to the width W2 of the print area 54 of the printing medium 12, and that the length L of the formed toner image 30 defines at least one band 50 (as shown in FIGS. 4a and 4b) of an image to be printed on the printing medium 12. Accordingly, to form a toner image 30 and align the toner image 30 with the width W2 of the printing medium 12, the ribbon 20 must be circulated a distance L during the formation of the toner image 30 and an additional distance necessary to move the formed toner image into alignment.

As should be understood, the band 50 defined by the formed toner image 30 is located at a predetermined position along the height H of the print area 54 of the printing medium 12, and the print area 54 is substantially filled with a plurality of the bands 50. As should be understood, then, the formed toner image 30 on the surface of the ribbon 20 is transferred to the printing medium 12 when the length L of the formed toner image 30 is aligned with the width W2 of the print area 54 of the printing medium 12 and when the printing medium 12 is transported to the predetermined position along the height H of the print area 54 of the printing medium 12.

As best seen in FIG. 2, a transfer mechanism 46 is employed to transfer the formed toner image 30 to the printing medium 12. Preferably, the image run 20a on which the formed toner image 30 resides is temporarily brought into substantially complete contact with the printing medium 12 just prior to the transfer. Preferably, and as seen in FIGS. 2 and 3, the transfer mechanism 46 is a transfer platen that is positioned adjacent the printing medium path 16 and the ribbon 20. More preferably, the transfer platen 46 is a generally planar metallic plate and is positioned in a plane parallel to the plane of the image run 20a and also to the plane of the printing medium path 16. Accordingly, and as should be understood, when the proper charge is applied to the transfer platen 46, the formed and aligned toner image 30 on the ribbon 20 is transferred to the printing medium 12. As seen in FIGS. 2 and 3, the transfer platen 46 and the image run 20a are positioned on opposite sides of the printing medium 12. However, one skilled in the art will recognize that the transfer platen 46 and the printing medium 12 may be positioned on opposite sides of the image run 20a without departing from the spirit and scope of the present invention. In such a case, it should be understood that the charge applied to the transfer platen 46 would be of the opposite polarity. Moreover, one skilled in the art will recognize that other transfer mechanisms 46 may be employed without departing from the spirit and scope of the present invention. For example, dual transfer platens may be respectively positioned above the image run 20a and below the printing medium path 16 or the transfer platen may be replaced with a transfer belt moving in synchronization with the printing medium 12, for example.

After the formed toner image 30 on the ribbon 20 has been transferred, the ribbon 20 may have a residual toner image (not shown) where the formed toner image 30 formerly resided. Accordingly, the cleaning unit 40 is positioned adjacent the ribbon 20 such that the cleaning unit 40 operates on the ribbon 20 after the formed toner image 30 has been transferred to the printing medium 12 by the transfer mechanism 46. As seen in FIG. 2, the cleaning unit 40 is adjacent the guide 26b, although the cleaning unit 40 may be positioned elsewhere as long as the ribbon 20 is cleaned before the charging unit 34 applies a uniform charge. Preferably, the cleaning unit 40 includes a cleaning roller that electrically removes the residual toner by applying a relatively large electrostatic charge to the ribbon 20 as the ribbon 20 passes by. Alternatively, the cleaning unit 40 may include a cleaning brush which mechanically removes the residual toner as the ribbon 20 passes by. Of course, one skilled in the art will recognize that other cleaning devices may be employed as the cleaning unit 40 without departing from the spirit and scope of the present invention. For example, a positively charged cleaning brush may be employed to both mechanically and electrically remove the residual toner as the ribbon 20 passes by.

After the toner image 30 has been transferred to the printing medium 12, a fixing mechanism 48 is employed to fix the transferred toner image to the printing medium 12. More particularly, and as seen in FIGS. 1 and 3, the fixing mechanism 48 may comprise a pair of rollers that receive the printing medium 12 and that apply pressure, heat, or a combination of pressure and heat to the printing medium 12 to fix the transferred toner image. Additionally, and as may be realized, the rollers in the fixing mechanism 48 may be employed as part of the transport mechanism 14 to transport the printing medium 12 along the printing medium path 16. In such a situation, it is preferable that the motor 15 driving the transport mechanism 14 also drive the fixing mechanism 48 through an appropriate linkage. Of course, one skilled in the art will recognize that other fixing devices may be employed as the fixing mechanism 48 without departing from the spirit and scope of the present invention. For example, a heating platen (not shown) may be positioned along the printing medium path 16 to fix the transferred toner image to the printing medium 12 as the printing medium 12 passes by.

Figure 5A:
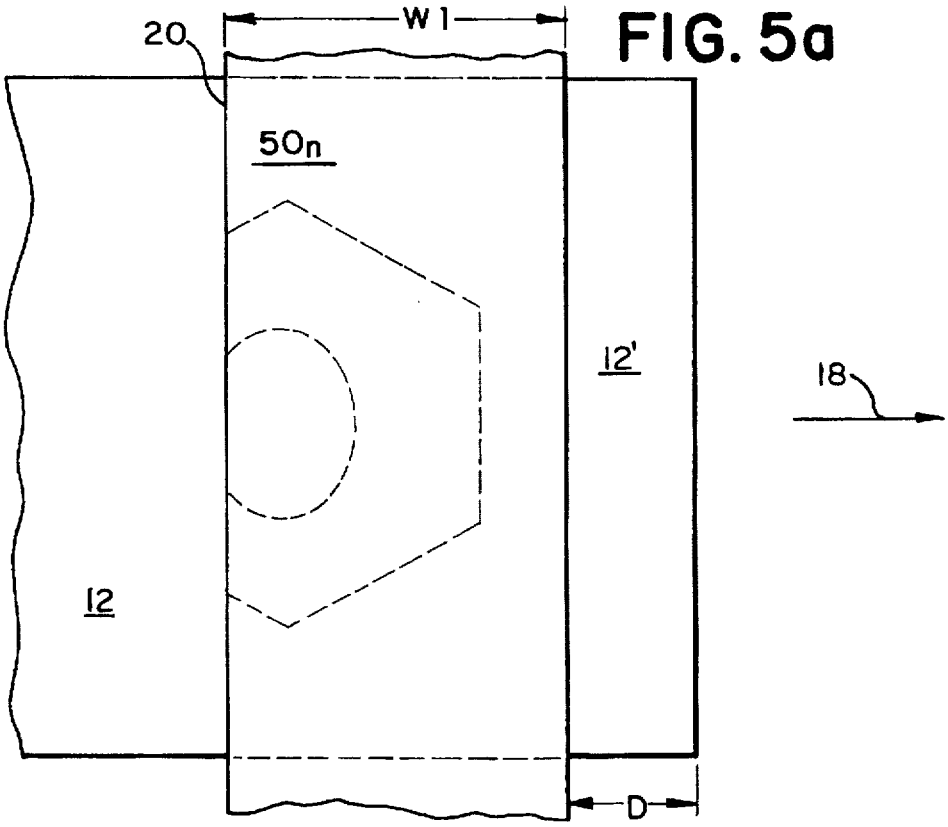
FIGS. 5*a* and 5*b* show an nth cycle image transfer from the ribbon to the printing medium of FIGS. 1–3 during monochrome printing (FIG. 5*a*) and during multichrome printing (FIG. 5*b*)
Figure 6A:
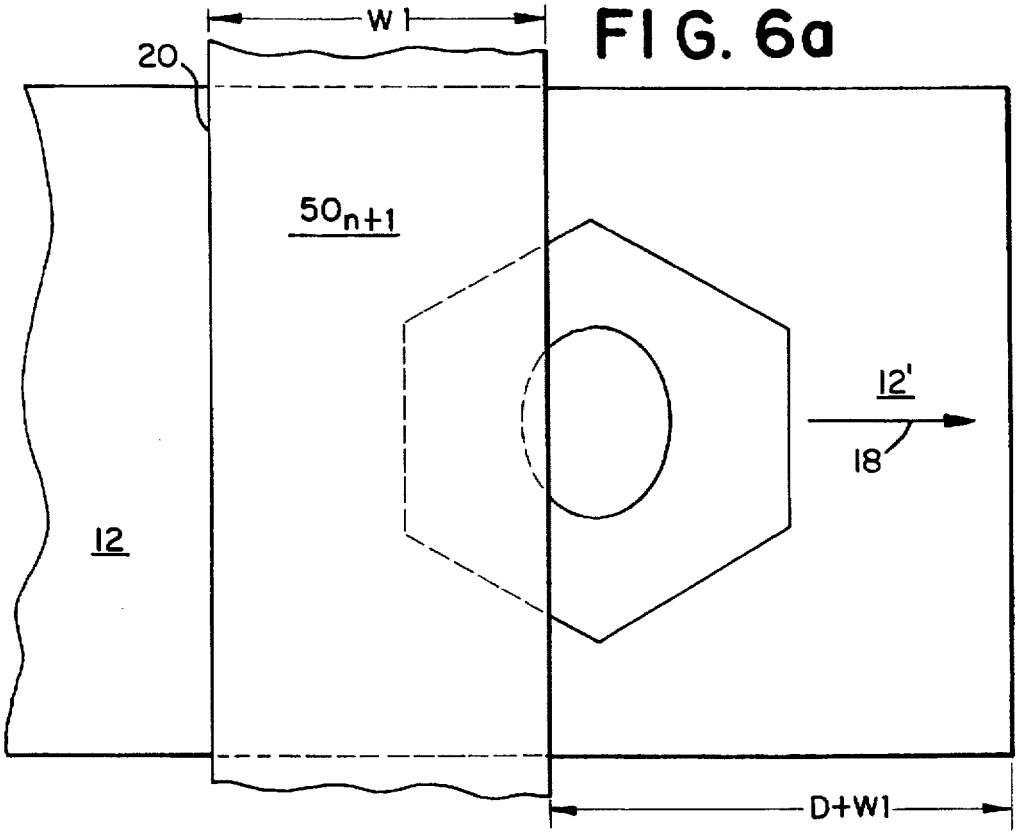
FIGS. 6*a* and 6*b* show an (n+1)th cycle image transfer from the ribbon to the printing medium of FIGS. 1–3 during monochrome printing (FIG. 6*a*) and during multichrome printing (FIG. 6*b*).

Referring now to FIGS. 4*a*, 5*a*, and 6*a*, the operation of the printer 10 during monochrome printing will be described. As should be understood, in monochrome printing, the image printed on the printing medium 12 is a single color, typically black, or is shaded and toned according to the single color. Accordingly, only one developer bin 44 is necessary to provide toner having the single color. Additionally, since only a single color is employed during monochrome printing, the formed toner image 30 defines a single band 50 of an image to be printed on the printing medium 12. Since only a single band 50 is on the ribbon 20, the band 50 preferably has a width substantially equal to the width W1 of the ribbon 20, as seen in FIG. 4*a*. As should be understood and as shown in FIG. 5*a*, in the context of the present invention, a band 50 is an elongated strip having a length L substantially equal to the width W2 of the print area 54 of the printing medium, and is formed on the ribbon 20 by the image forming apparatus 24 as a single color toner image 30.

Referring now to FIG. 5*a*, an nth band $\mathbf{50}_n$ is shown as it has been formed on the ribbon 20 and aligned and positioned with respect to the printing medium 12. As shown, the leading portion 12' of the printing medium 12 has already been printed on by the printer 10, and the leading portion 12' extends a distance D beyond the ribbon 20 in the first direction 18 while the toner image 30 defining the nth band $\mathbf{50}_n$ is being transferred to the printing medium 12.

After the toner image 30 defining the nth band $\mathbf{50}_n$ has been transferred to the printing medium 12, the ribbon 20 is circulated such that a subsequent formed toner image 30 defines an (n+1)th band $\mathbf{50}_{n+1}$ on the ribbon 20 and the printing medium 12 is transported along the printing medium path 16 a distance substantially equal to W1 so that the leading portion 12' of the printing medium 12 extends beyond the ribbon 20 a distance D+W1, as seen in FIG. 6*a*. Thereafter, the (n+1)th band $\mathbf{50}_{n+1}$ is transferred. As should now be understood, the process is repeated until the (n+2)th, (n+3)th, etc. bands $\mathbf{50}_{n+2}$, $\mathbf{50}_{n+3}$, etc. complete the printing of the image data on the printing medium 12.

Figure 5B:
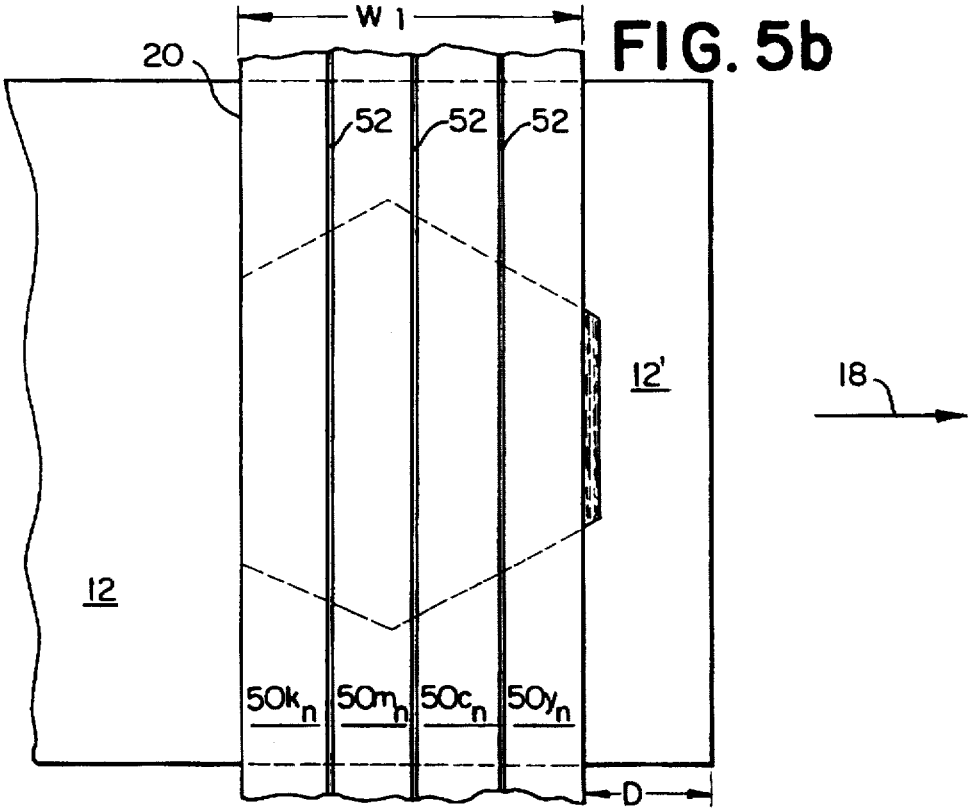
Figure 6B:
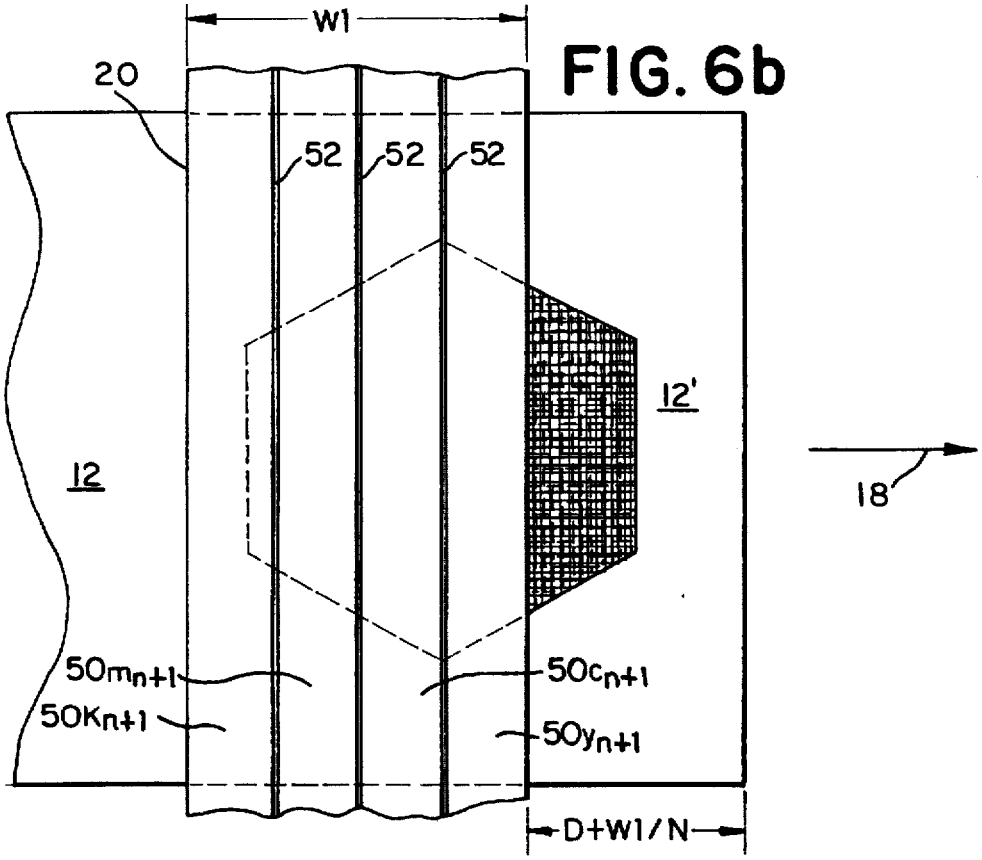

Referring now to FIGS. 4*b*, 5*b* and 6*b*, the operation of the printer 10 during multichrome or color printing will be described. As should be understood, to print in color, it is necessary that multiple colors of toner 32 be provided and stored in multiple developer bins 44 (not shown), and that multiple single-color toner images be overlaid to produce the desired multichrome or color images.

To print a multichrome or color image on the printing medium 12, then, it is preferable that the formed toner image 30 defines a number of bands N of an image to be printed on the printing medium. Each band defined by the toner image 30 has a length L substantially equal to the width W2 of the print area 54 of the printing medium 12, and a width substantially equal to the width W1 of the ribbon 20 divided by the number of bands N, i.e. a width W1/N. Preferably, at least some of the number of bands N have different color toner images. More preferably, each band has a different color toner image. Still more preferably, the different color toner images comprise black (K), magenta (M), cyan (C), and yellow (Y) and define a black band 50*k*, a magenta band 50*m*, a cyan band 50*c*, and a yellow band 50*y*, as shown in FIG. 4*b*.

Referring now to FIG. 5*b*, nth bands $\mathbf{50}k_n$, $\mathbf{50}m_n$, $\mathbf{50}c_n$, and $\mathbf{50}y_n$ are shown as they have been formed on the ribbon 20 and aligned and positioned with respect to the printing medium 12. As shown, the leading portion 12' of the printing medium 12 has already been printed on by the printer 10, and the leading portion 12' extends a distance D beyond the ribbon 20 in the first direction 18 while the toner image 30 on the nth bands $\mathbf{50}k_n$, $\mathbf{50}m_n$, $\mathbf{50}c_n$, and $\mathbf{50}y_n$ is being transferred to the printing medium 12.

After the toner image 30 defining the nth bands $\mathbf{50}k_n$, $\mathbf{50}m_n$, $\mathbf{50}c_n$, and $\mathbf{50}y_n$ has been transferred to the printing medium 12, the ribbon 20 is circulated such that a subsequent toner image 30 defines (n+1)th bands $\mathbf{50}k_{n+1}$, $\mathbf{50}m_{n+1}$, $\mathbf{50}c_{n+1}$, and $\mathbf{50}y_{n+1}$ on the ribbon 20 and the printing medium 12 is transported along the printing medium path 16 a distance substantially equal to W1/N so that the leading portion 12' of the printing medium 12 extends beyond the ribbon 20 a distance D+W1/N, as seen in FIG. 6*a*. Thereafter, the (n+1)th bands $\mathbf{50}k_{n+1}$, $\mathbf{50}m_{n+1}$, $\mathbf{50}c_{n+1}$, and $\mathbf{50}y_{n+1}$ are transferred. As should now be understood, the process is repeated until the (n+2)th, (n+3)th, etc. series of bands $\mathbf{50}k,m,c,y_{n+2}$, $\mathbf{50}k,m,c,y_{n+3}$, etc. complete the printing of the image data on the printing medium 12. Accordingly, bands $\mathbf{50}k_n$, $\mathbf{50}m_{n+1}$, $\mathbf{50}c_{n+2}$, and $\mathbf{50}y_{n+3}$ overlap to form a full color image on the printing medium 12.

It may be necessary to have a relatively small space 52 between adjacent bands 50*k*, 50*m*, 50*c*, 50*y* on the ribbon 20 in connection with multichrome or color printing, as seen in FIG. 4*b*. As should be understood, since the multiple developer bins 44 (not shown) each feed to the one or more developer rollers 42, gaskets or other sealing devices must be employed between the developer bins 44 to prevent intermixing of the colored toners from each of the bins 44. Although such gaskets can be relatively small, on the order of 1/10th of an inch or less, they nevertheless result in the relatively small spaces 52 appearing between the bands on the ribbon 20. Since each of the relatively small spaces 52 occupies some portion of the width W1 of the ribbon 20, each band 50*k*, 50*m*, 50*c*, 50*y* may have a width slightly less than W1/N.

To at least partially compensate for the reduction in width caused by the spaces 52, it is preferable that the printing medium 12 be transported along the printing medium path 16 a distance slightly less than W1/N between the transfer of successive formed toner images. As may be understood, traveling such a lesser distance avoids having small blank lines at regular intervals on the printing medium 14. To further compensate for the reduction in width caused by the spaces 52, it is also preferable that each edge of each band 50*k*, 50*m*, 50*c*, 50*y* be feathered such that the edge blends into an adjacent band on the printing medium 14.

As should be understood, it is necessary that the formed toner image 30 on the ribbon 20 be relatively accurately aligned with the width W2 of the print area 54 of the printing medium 12 and also along the height H of the print area 54 of the printing medium 12. To achieve such alignment and maintain such alignment during transfer, it may be necessary to momentarily stop the transport of the printing medium 12 along the printing medium path 16, and/or the circulation of the ribbon 20. Preferably, such stopping occurs before the transfer of the formed toner image 30 on the surface of the ribbon 20 to the printing medium 12.

However, it may be preferable to increase printing speed by continuously transporting the printing medium 12 along the printing medium path 16 and/or by continuously circulating the ribbon 20 during the transfer of the formed toner image 30 on the surface of the ribbon 20 to the printing medium 12. As one skilled in the art will recognize, the continuous transporting of the printing medium 12 along the printing medium path 16 may be achieved by moving the ribbon 20, the imaging apparatus 24, and associated elements in the first direction 18 along with the printing medium 12 during the transfer of the formed toner image 30 on the surface of the ribbon 20 to the printing medium 12. After the transfer has been completed, the ribbon 20, the imaging apparatus 24, and the associated elements are moved back and then again moved in the first direction 18 along with the printing medium 12 during the transfer of a subsequent toner image 30.

Alternatively, the ribbon 20, the imaging apparatus 24, and associated elements may remain stationary in the printer 10 and other hardware and/or software devices may be employed to allow the printing medium 12 to be continuously transported. For example, the image data employed to form the toner image 30 may be modified to take into account the continuous transportation of the printing medium 12, among other things. One skilled in the art will additionally recognize that such hardware and/or software devices may also be employed to allow the continuous circulation of the ribbon 30 during the transfer of the formed toner image 30 on the surface of the ribbon 20 to the printing medium 12.

From the foregoing description, it can be seen that the present invention comprises a new and useful band printer and method for operation of a band printer. As may be seen, the band printer may be relatively small as compared with a drum printer, requires a relatively short LED array, and can form multichrome or color images at a relatively low cost. It will be appreciated by those skilled in the art that changes could be made to the embodiments described above without departing from the broad inventive concepts thereof. It is understood, therefore, that this invention is not limited to the particular embodiments disclosed, but it is intended to cover modifications within the spirit and scope of the present invention as defined by the appended claims.

I claim:

1. A band printer comprising:

a transport mechanism defining a printing medium path extending in a first direction, the transport mechanism for transporting a printing medium along the printing medium path;

an endless photoreceptive image carrying ribbon having a surface, the ribbon for being circulated adjacent the printing medium path in a second direction at an angle to the first direction;

a toner imaging apparatus adjacent to and stationary with respect to the circulating ribbon for forming an electrostatic toner image on the surface of the ribbon according to received image data as the ribbon moves past the imaging apparatus;

a transfer mechanism for transferring a formed toner image on the surface of the ribbon to the printing medium when the formed toner image is aligned with the printing medium; and a fixing mechanism for fixing the transferred toner image to the printing medium, wherein the printing medium is continuously transported along the printing medium path during the transfer of the formed toner image on the surface of the ribbon to the printing medium.

2. The band printer of claim 1 wherein the second direction is generally orthogonal to the first direction.

3. The band printer of claim 2 wherein the ribbon has a width W1 and the formed toner image defines a single band of an image to be printed on the printing medium, the band having a width substantially equal to W1, the printing medium being transported along the printing medium path a distance substantially equal to W1 between the transfer of successive formed toner images.

4. The band printer of claim 2 wherein the ribbon has a width W1 and the formed toner image defines a plurality of bands N of an image to be printed on the printing medium, each band having a width substantially equal to W1/N, the printing medium being transported along the printing medium path a distance substantially equal to W1/N between the transfer of successive formed toner images.

5. The band printer of claim 4 wherein each band has a width slightly less than W1/N such that a relatively small space is defined between adjacent bands, the printing medium being transported along the printing medium path a distance slightly less than W1/N between the transfer of successive formed toner images.

6. The band printer of claim 4 wherein at least some of the plurality of bands N have different color toner images.

7. The band printer of claim 4 wherein each of the plurality of bands N has a different color toner image.

8. The band printer of claim 7 wherein the different color toner images comprise black, magenta, cyan, and yellow color toner images.

9. The band printer of claim 2 wherein the printing medium has a predetermined print area including a width W2 generally orthogonal to the first direction and a height H generally parallel to the first direction, the formed toner image has a length L substantially equal to the width W2 of the print area of the printing medium and defines a band of an image to be printed on the printing medium, the band being located at a predetermined position along the height H of the print area of the printing medium, and wherein the formed toner image on the surface of the ribbon is transferred to the printing medium when the length L of the formed toner image is aligned with the width W2 of the print area of the printing medium and when the printing medium is transported to the predetermined position along the height H of the print area of the printing medium.

10. The band printer of claim 1 further comprising first and second guides having generally parallel axes spaced a set distance apart, the axes generally extending in the first direction, the printing medium path extending therebetween, the ribbon being mounted on the first and second guides for being circulated therearound.

11. The band printer of claim 10 wherein the first and second guides are first and second rollers.

12. The band printer of claim 10 further comprising a circulating mechanism for circulating the ribbon around the first and second guides at a predetermined velocity.

13. The band printer of claim 1 wherein the toner imaging apparatus comprises:

a charging unit for placing a uniform charge on the ribbon;

an imaging unit for selectively discharging portions of the ribbon to form a discharge image on the ribbon;

a developing unit for covering the discharge image with a charged toner to form the toner image on the ribbon; and a cleaning unit for removing residual toner after the formed toner image on the ribbon is transferred.

14. The band printer of claim 1 wherein the transfer mechanism comprises a transfer platen adjacent the printing medium path and the ribbon, the formed toner image on the ribbon being transferred to the printing medium when a charge is applied to the transfer platen.

15. The band printer of claim 1 wherein the fixing mechanism fixes the transferred toner image to the printing medium by application of a member of the group consisting of pressure, heat, and a combination of pressure and heat.

16. The band printer of claim 1 wherein the circulation of the ribbon is momentarily stopped during the transfer of the formed toner image on the surface of the ribbon to the printing medium.

17. The band printer of claim 1 wherein the ribbon is moved in the first direction along with the printing medium during the transfer of the formed toner image on the surface of the ribbon to the printing medium.

18. The band printer of claim 1 wherein the ribbon is continuously circulated during the transfer of the formed toner image on the surface of the ribbon to the printing medium.

19. A method for band printing comprising the steps of:

transporting a printing medium along a printing medium path extending in a first direction;

circulating an endless photoreceptive image carrying ribbon adjacent the printing medium path in a second direction at an angle to the first direction, the ribbon having a surface;

forming an electrostatic toner image on the surface of the ribbon according to received image data as the ribbon moves past a toner imaging apparatus adjacent to and stationary with respect to the circulating ribbon;

transferring a formed toner image on the surface of the ribbon to the printing medium when the formed toner image is aligned with the printing medium;

fixing the transferred toner image to the printing medium; and continuously transporting the printing medium along the printing medium path during the transfer of the formed toner image on the surface of the ribbon to the printing medium.

20. The method of claim 19 wherein the circulating comprises circulating the ribbon in a second direction generally orthogonal to the first direction.

21. The method of claim 20 wherein the ribbon has a width W1 and the formed toner image defines a single band of an image to be printed on the printing medium, the band having a width substantially equal to W1, and wherein the transporting step further comprises transporting the printing medium along the printing medium path a distance substantially equal to W1 between the transfer of successive formed toner images.

22. The method of claim 20 wherein the ribbon has a width W1 and the formed toner image defines a plurality of bands N of an image to be printed on the printing medium, each band having a width substantially equal to W1/N, and wherein the transporting step further comprises transporting the printing medium along the printing medium path a distance substantially equal to W1/N between the transfer of successive formed toner images.

23. The method of claim 22 wherein each band has a width slightly less than W1/N such that a relatively small space is defined between adjacent bands, and wherein the transporting step comprises transporting the printing medium along the printing medium path a distance slightly less than W1/N between the transfer of successive formed toner images.

24. The method of claim 20 wherein the printing medium has a predetermined print area including a width W2 generally orthogonal to the first direction and a height H generally parallel to the first direction, the formed toner image has a length L substantially equal to the width W2 of the print area of the printing medium and defines a band of an image to be printed on the printing medium, the band being located at a predetermined position along the height H of the print area of the printing medium, and wherein the transferring step further comprises transferring the formed toner image on the surface of the ribbon to the printing medium when the length L of the formed toner image is aligned with the width W2 of the print area of the printing medium and when the printing medium is transported to the predetermined position along the height H of the print area of the printing medium.

25. The method of claim 19 wherein the circulating step further comprises circulating the ribbon around first and second guides having generally parallel axes spaced a set distance apart, the axes generally extending in the first direction, the printing medium path extending therebetween.

26. The method of claim 25 wherein the circulating step further comprises circulating the ribbon around first and second rollers.

27. The method of claim 25 wherein the circulating step further comprises circulating the ribbon around the first and second guides at a predetermined velocity.

28. The method of claim 19 wherein the forming step further comprises the steps of:

placing a uniform charge on the ribbon;

selectively discharging portions of the ribbon to form a discharge image on the ribbon;

covering the discharge image with a charged toner to form the toner image on the ribbon; and removing residual toner after the formed toner image on the ribbon is transferred.

29. The method of claim 19 wherein the transferring step further comprises applying a charge to a transfer platen adjacent the printing medium path and the ribbon to transfer the formed toner image on the ribbon to the printing medium.

30. The method of claim 19 wherein the fixing step comprises applying a member of the group consisting of pressure, heat, and a combination of pressure and heat to fix the transferred toner image to the printing medium.

31. The method of claim 19 further comprising the step of momentarily stopping the circulation of the ribbon during the transfer of the formed toner image on the surface of the ribbon to the printing medium.

32. The method of claim 19 further comprising the step of moving the ribbon in the first direction along with the printing medium during the transfer of the formed toner image on the surface of the ribbon to the printing medium.

33. The method of claim 19 further comprising the step of continuously circulating the ribbon during the transfer of the formed toner image on the surface of the ribbon to the printing medium.

34. A band printer comprising:

a transport mechanism defining a printing medium path extending in a first direction, the transport mechanism for transporting a printing medium along the printing medium path;

an endless photoreceptive image carrying ribbon having a surface, the ribbon for being circulated adjacent the printing medium path in a second direction at an angle to the first direction;

a toner imaging apparatus adjacent to and stationary with respect to the circulating ribbon for forming an electrostatic toner image on the surface of the ribbon according to received image data as the ribbon moves past the imaging apparatus;

a transfer mechanism for transferring a formed toner image on the surface of the ribbon to the printing medium when the formed toner image is aligned with the printing medium; and a fixing mechanism for fixing the transferred toner image to the printing medium, wherein the ribbon is continuously circulated during the transfer of the formed toner image on the surface of the ribbon to the printing medium.

35. The band printer of claim 34 wherein the second direction is generally orthogonal to the first direction.

36. The band printer of claim 35 wherein the ribbon has a width W1 and the formed toner image defines a single band of an image to be printed on the printing medium, the band having a width substantially equal to W1, the printing medium being transported along the printing medium path a distance substantially equal to W1 between the transfer of successive formed toner images.

37. The band printer of claim 35 wherein the ribbon has a width W1 and the formed toner image defines a plurality of bands N of an image to be printed on the printing medium, each band having a width substantially equal to W1/N, the printing medium being transported along the printing medium path a distance substantially equal to W1/N between the transfer of successive formed toner images.

38. The band printer of claim 37 wherein each band has a width slightly less than W1/N such that a relatively small space is defined between adjacent bands, the printing medium being transported along the printing medium path a distance slightly less than W1/N between the transfer of successive formed toner images.

39. The band printer of claim 37 wherein at least some of the plurality of bands N have different color toner images.

40. The band printer of claim 37 wherein each of the plurality of bands N has a different color toner image.

41. The band printer of claim 40 wherein the different color toner images comprise black, magenta, cyan, and yellow color toner images.

42. The band printer of claim 35 wherein the priming medium has a predetermined print area including a width W2 generally orthogonal to the first direction and a height H generally parallel to the first direction, the formed toner image has a length L substantially equal to the width W2 of the print area of the printing medium and defines a band of an image to be printed on the printing medium, the band being located at a predetermined position along the height H of the print area of the printing medium, and wherein the formed toner image on the surface of the ribbon is transferred to the printing medium when the length L of the formed toner image is aligned with the width W2 of the print area of the printing medium and when the printing medium is transported to the predetermined position along the height H of the print area of the printing medium.

43. The band printer of claim 34 further comprising first and second guides having generally parallel axes spaced a set distance apart, the axes generally extending in the first direction, the printing medium path extending therebetween, the ribbon being mounted on the first and second guides for being circulated therearound.

44. The band printer of claim 43 wherein the first and second guides are first and second rollers.

45. The band printer of claim 43 further comprising a circulating mechanism for circulating the ribbon around the first and second guides at a predetermined velocity.

46. The band printer of claim 34 wherein the toner imaging apparatus comprises:

a charging unit for placing a uniform charge on the ribbon;

an imaging unit for selectively discharging portions of the ribbon to form a discharge image on the ribbon;

a developing unit for covering the discharge image with a charged toner to form the toner image on the ribbon; and a cleaning unit for removing residual toner after the formed toner image on the ribbon is transferred.

47. The band printer of claim 34 wherein the transfer mechanism comprises a transfer platen adjacent the printing medium path and the ribbon, the formed toner image on the ribbon being transferred to the printing medium when a change is applied to the transfer platen.

48. The band printer of claim 34 wherein the fixing mechanism fixes the transferred toner image to the printing medium by application of a member of the group consisting of pressure, heat, and a combination of pressure and heat.

49. The band printer of claim 34 wherein the printing medium is continuously transported along the printing medium path during the transfer of the formed toner image on the surface of the ribbon to the printing medium.

50. The band printer of claim 34 wherein the ribbon is moved in the first direction along with the printing medium during the transfer of the formed toner image on the surface of the ribbon to the printing medium.

51. The band printer of claim 34 wherein the transport of the printing medium along the printing medium path is momentarily stopped during the transfer of the formed toner image on the surface of the ribbon to the printing medium.

52. A method for band printing comprising the steps of:

transporting a printing medium along a printing medium path extending in a first direction;

circulating an endless photoreceptive image carrying ribbon adjacent the printing medium path in a second direction at an angle to the first direction, the ribbon having a surface;

forming an electrostatic toner image on the surface of the ribbon according to received image data as the ribbon moves past a toner imaging apparatus adjacent to and stationary with respect to the circulating ribbon;

transferring a formed toner image on the surface of the ribbon to the printing medium when the formed toner image is aligned with the printing medium;

fixing the transferred toner image to the printing medium; and continuously circulating the ribbon during the transfer of the formed toner image on the surface of the ribbon to the printing medium.

53. The method of claim 52 wherein the circulating comprises circulating the ribbon in a second direction generally orthogonal to the first direction.

54. The method of claim 53 wherein the ribbon has a width W1 and the formed toner image defines a single band of an image to be printed on the printing medium, the band having a width substantially equal to W1, and wherein the transporting step further comprises transporting the printing medium along the printing medium path a distance substantially equal to W1 between the transfer of successive formed toner images.

55. The method of claim 53 wherein the ribbon has a width W1 and the formed toner image defines a plurality of bands N of an image to be printed on the printing medium, each band having a width substantially equal to W1/N, and wherein the transporting step further comprises transporting the printing medium along the printing medium path a distance substantially equal to W1/N between the transfer of successive formed toner images.

56. The method of claim 55 wherein each band has a width slightly less than W1/N such that a relatively small space is defined between adjacent bands, and wherein the transporting step comprises transporting the printing medium along the printing medium path a distance slightly less than W1/N between the transfer of successive formed toner images.

57. The method of claim 55 wherein the printing medium has a predetermined print area including a width W2 generally orthogonal to the first direction and a height H generally parallel to the first direction, the formed toner image has a length L substantially equal to the width W2 of the print area of the printing medium and defines a band of an image to be printed on the printing medium, the band being located at a predetermined position along the height H of the print area of the printing medium, and wherein the transferring step further comprises transferring the formed toner image on the surface of the ribbon to the printing medium when the length L of the formed toner image is aligned with the width W2 of the print area of the printing medium and when the printing medium is transported to the predetermined position along the height H of the print area of the printing medium.

58. The method of claim 52 wherein the circulating step further comprises circulating the ribbon around first and second guides having generally parallel axes spaced a set distance apart, the axes generally extending in the first direction, the printing medium path extending therebetween.

59. The method of claim 58 wherein the circulating step further comprises circulating the ribbon around first and second rollers.

60. The method of claim 58 wherein the circulating step further comprises circulating the ribbon around the first and second guides at a predetermined velocity.

61. The method of claim 52 wherein the forming step further comprises the steps of:

placing a uniform charge on the ribbon;

selectively discharging portions of the ribbon to form a discharge image on the ribbon;

covering the discharge image with a charged toner to form the toner image on the ribbon; and removing residual toner after the formed toner image on the ribbon is transferred.

62. The method of claim 52 wherein the transferring step further comprises applying a charge to a transfer platen adjacent the printing medium path and the ribbon to transfer the formed toner image on the ribbon to the printing medium.

63. The method of claim 52 wherein the fixing step comprises applying a member of the group consisting of pressure, heat, and a combination of pressure and heat to fix the transferred toner image to the printing medium.

64. The method of claim 52 further comprising the step of continuously transporting the printing medium along the printing medium path during the transfer of the formed toner image on the surface of the ribbon to the printing medium.

65. The method of claim 52 further comprising the step of moving the ribbon in the first direction along with the printing medium during the transfer of the formed toner image on the surface of the ribbon to the printing medium.

66. The method of claim 52 further comprising the steps of momentarily stopping the transport of the printing medium along the printing medium path during the transfer of the formed toner image on the surface of the ribbon to the printing medium.

* * * * *